US007943871B2

(12) United States Patent
Crutcher

(10) Patent No.: US 7,943,871 B2
(45) Date of Patent: May 17, 2011

(54) ROTATIONAL STABILIZER

(75) Inventor: Bernard C. Crutcher, Londonderry, NH (US)

(73) Assignee: Hubbell Incorporated, Shelton, CT (US)

( * ) Notice: Subject to any disclaimer, the term of this patent is extended or adjusted under 35 U.S.C. 154(b) by 408 days.

(21) Appl. No.: 12/290,199

(22) Filed: Oct. 27, 2008

(65) Prior Publication Data

US 2009/0173612 A1 Jul. 9, 2009

Related U.S. Application Data

(60) Provisional application No. 61/010,675, filed on Jan. 9, 2008.

(51) Int. Cl.
*H01H 9/00* (2006.01)

(52) U.S. Cl. ..... 200/17 R

(58) Field of Classification Search ..... 200/17 R, 200/48 R–48 CB, 561, 330–331, 50.1; 439/783, 439/477; 174/135, 138 R, 146, 169, 177; 218/10

See application file for complete search history.

(56) References Cited

U.S. PATENT DOCUMENTS

| | | | | |
|---|---|---|---|---|
| 2,178,351 | A | 10/1939 | Tetens | |
| 3,247,347 | A | 4/1966 | Lindsay | 200/144 |
| 3,567,887 | A | 3/1971 | Maloney | 200/153 |
| 3,621,160 | A * | 11/1971 | Turner | 200/48 R |
| 3,727,019 | A | 4/1973 | Harvey | 200/144 B |
| 4,098,546 | A * | 7/1978 | Swartz et al. | 439/20 |
| 4,495,390 | A | 1/1985 | Leppers et al. | 200/145 |
| 4,661,662 | A | 4/1987 | Finke et al. | 200/48 |
| 5,507,671 | A | 4/1996 | Chadbourne et al. | 439/783 |
| 5,581,051 | A * | 12/1996 | Hill | 174/138 R |
| 6,362,445 | B1 | 3/2002 | Marchand et al. | 218/155 |
| 7,498,528 | B2 * | 3/2009 | De France | 200/17 R |
| 2007/0295691 | A1 * | 12/2007 | Crutcher | 218/10 |
| 2008/0026644 | A1 * | 1/2008 | De France et al. | 439/783 |

FOREIGN PATENT DOCUMENTS

CA 2092741 5/2004

OTHER PUBLICATIONS

"AMPACT* In-Line Disconnect Assemblies", product information sheet 408-4097, Feb. 1996, pp. 1-4.

"TriMod® 300 Three Phase Vacuum Recloser", product information sheet DB 706-301, Jul. 2002, 4 pages.

"Scada-Mate® Switching Systems", product information sheet, Mar. 15, 2006, 2 pages.

"S&C TripSaver™ Dropout Recloser for enhanced lateral circuit protection at 15.5kV and 25 kV", Descriptive Bulletin 461-30, May 15, 2006, 8 pages.

* cited by examiner

*Primary Examiner* — Edwin A. Leon
(74) *Attorney, Agent, or Firm* — Harrington & Smith

(57) ABSTRACT

An in-line electrical conductor switch including a frame, an electrical connection section movably connected to the frame, and a rotational stability device. The frame includes first and second connection sections insulated from each other by an electrical isolation section. The first and second connection sections are configured to connect to respective ends of first and second electrical conductors. The switch is entirely supported by the first and second electrical conductors. The electrical connection section is movably connected to the frame between a first connected position and a second disconnected position. The rotational stability device is connected to the frame and adapted to reduce or prevent rotation of the frame about an axis through the ends of the electrical conductors during movement of the electrical connection section to the second disconnected position.

22 Claims, 3 Drawing Sheets

ROTATIONAL STABILIZER

CROSS REFERENCE TO RELATED APPLICATION

This application claims priority under 35 U.S.C. 119(e) upon U.S. Provisional Patent Application No. 61/010,675 filed Jan. 9, 2008, which is hereby incorporated by reference in its entirety.

BACKGROUND OF THE INVENTION

1. Field of the Invention

The invention relates to a stabilizing system and, more particularly, to a system for preventing a device from rotating.

2. Brief Description of Prior Developments

In-line disconnect switches or other similar conductor mounted, conductor supported devices attached onto distribution and transmission conductors are free standing and not attached to any stationary support or stabilizing device. An example is shown in Canadian Patent No. 2,092,741. These devices, when required, must be opened and closed on occasion when "sectionalizing" a circuit or performing service to the circuit. There is a common problem that a service crew experiences when opening and predominately when closing a switch latch by hot stick. The entire device tends to rotate on the conductor axis during the attempt. Unless the service crew stops the rotation (spin), then positions his/herself directly under the device, lining up the switch handle so that the upward pushing force being applied is parallel with the conductor, the switch may have difficultly closing or not close all the way. This can obviously create a safety issue.

There is a desire to provide a device which is easier to close and, therefore, less prone to create safety issues.

SUMMARY OF THE INVENTION

In accordance with one aspect of the invention, an in-line electrical conductor switch is provided including a frame, an electrical connection section movably connected to the frame, and a rotational stability device. The frame includes first and second connection sections insulated from each other by an electrical isolation section. The first and second connection sections are configured to connect to respective ends of first and second electrical conductors. The switch is entirely supported by the first and second electrical conductors. The electrical connection section is movably connected to the frame between a first connected position and a second disconnected position. The rotational stability device is connected to the frame and adapted to reduce or prevent rotation of the frame about an axis through the ends of the electrical conductors during movement of the electrical connection section to the second disconnected position.

In accordance with another aspect of the invention, a device is provided comprising a frame, an electronic device mounted to the frame, and a rotational stabilizer. The frame comprises first and second connection sections insulated from each other by an electrical isolation section. The first and second connection sections are configured to connect to respective ends of first and second electrical conductors. The device is entirely supported by the first and second electrical conductors. The rotational stabilizer is connected to the frame and adapted to reduce or prevent rotation of the frame about an axis through the ends of the electrical conductors. The rotational stabilizer stabilizes the frame to thereby stabilize the electronic device and reduce rotational motion of the electronic device about the axis.

In accordance with another aspect of the invention, a method of manufacturing a device is provided comprising providing a frame comprising first and second connection sections insulated from each other by an electrical isolation section, wherein the first and second connection sections are configured to connect to respective ends of first and second electrical conductors, and wherein the device is entirely supported by the first and second electrical conductors; connecting an electrical connection section to the frame, wherein the electrical connection section is movably connected to the frame between a first connected position which electrically connects the first and second connection sections to each other, and a second disconnected position which does not electrically connect the first and second connection sections to each other; and connecting a rotational stabilizer to the frame, wherein the rotational stabilizer is adapted to reduce or prevent rotation of the frame about an axis through the ends of the electrical conductors during movement of the electrical connection section to the second disconnected position.

In accordance with another aspect of the invention, a method of closing an electrical switch comprising providing the electrical switch with a frame comprising first and second connection sections insulated from each other by an electrical isolation section, wherein the first and second connection sections are configured to connect to respective ends of first and second electrical conductors, wherein the switch is entirely supported by the first and second electrical conductors; moving an electrical connection section on the frame from a disconnected position to a connected position, wherein in the disconnected position the electrical connection section does not electrically connect the first and second connection sections to each other, and wherein in the connected position the electrical connection section electrically connects the first and second connection sections to each other; and preventing the frame from significantly rotating about an axis through the ends of the first and second electrical conductors while the electrical connection section is moved to the connection position comprising a gyroscope on the frame creating an artificial center of gravity.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
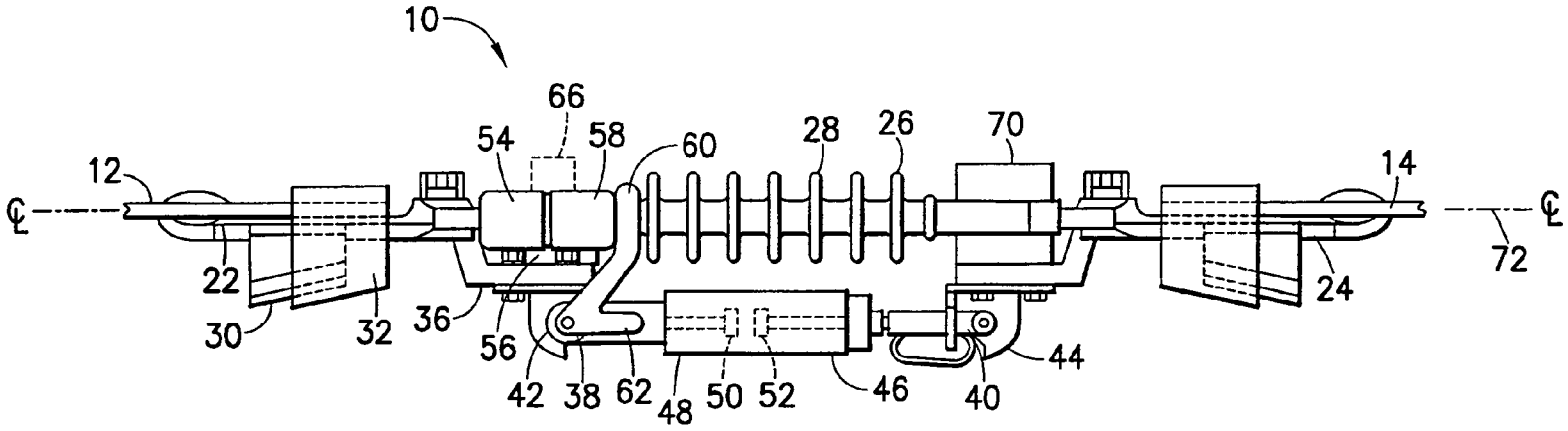
FIG. 1 is an elevational side view of a device incorporating features of the invention shown connected in-line between two conductors.

Referring to FIG. 1, there is shown an elevational side view of an in-line electrical conductor switch 10 incorporating features of the invention. In this embodiment the switch 10 is a vacuum recloser type of switch. A similar type of device is described in U.S. patent application Ser. Nos. 11/586,970 and 11/778,755 which are hereby incorporated by reference in their entireties. However, in alternate embodiments the in-line electrical conductor switch might not be a vacuum recloser type of switch. The switch could merely be a manual only user actuated type of switch, such as shown in Canadian Patent No. 2,092,741 for example.

Although the invention will be described with reference to the exemplary embodiments shown in the drawings, it should be understood that the invention can be embodied in many alternate forms of embodiments. In addition, any suitable size, shape or type of elements or materials could be used.

The switch 10 is shown connecting a first electrical conductor 12 to a second electrical conductor 14. For example, the conductors 12, 14 could be high voltage overhead power distribution lines. However, the switch 10 could be used in any suitable application. The switch 10 forms an electrical switch between the two conductors 12, 14. When the switch is open, the first and second conductors 12, 14 are not electrically connected to each other through the switch. When the switch is closed, the first and second conductors 12, 14 are electrically connected to each other through the switch. In this embodiment the switch 10 is an in-line design connected aligned in-line between the two conductors 12, 14. However, in alternate embodiments, the switch could be provided other than in an in-line design.

Figure 2:
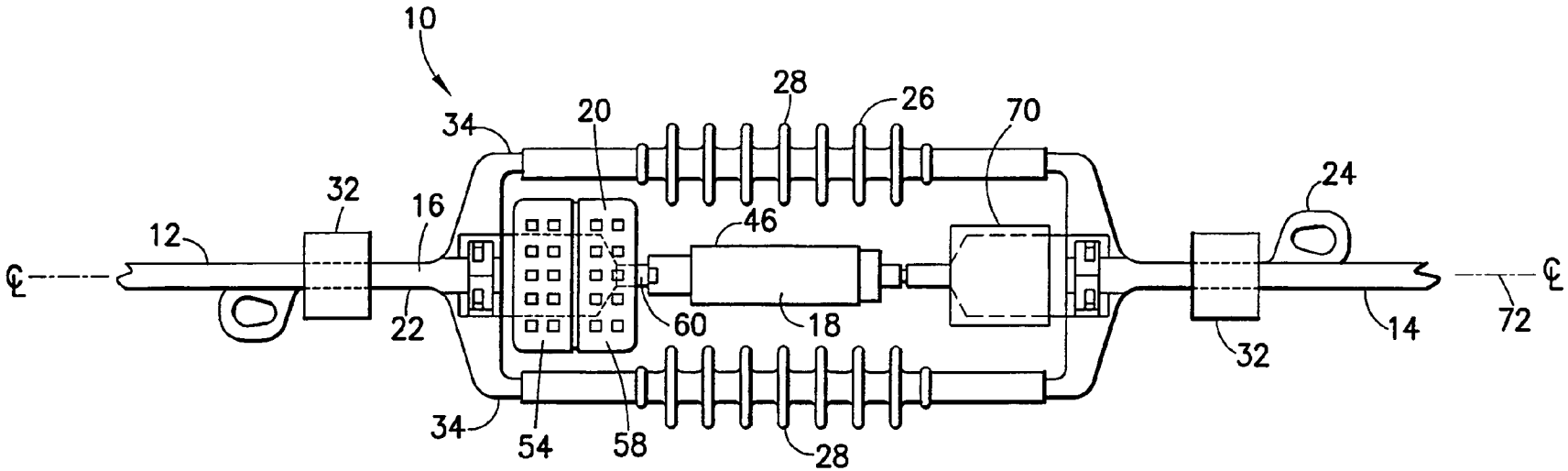
FIG. 2 is a plan top view of the device shown in FIG. 1.

Referring also to FIG. 2, the switch 10 generally comprises a frame 16, an electrical connection section 18, and a control 20. The frame 16 generally comprises a first connection section 22, a second connection section 24, and an electrical isolation section 26. The electrical isolation section 26 structurally connects the first connection section 22 to the second connection section 24. In this embodiment the electrical isolation section 26 comprises two parallel sections 28. Each section 28 has two opposite ends connected to the first and second connection sections, respectively. An open area is formed between the two sections 28. Each section 28 comprises an electrical insulator assembly for electrically insulating the opposite ends of each section 28 from each other and, thus, electrically insulating the first and second sections 22, 24 from each other while still structurally connecting the sections 22, 24 to each other.

In this embodiment, the first and second sections 22, 24 are substantially mirror images of each other. However, in alternate embodiments the two sections 22, 24 could be different. The first connection section 22 is preferably comprised of metal, such as cast metal for example. The first connection section 22 generally comprises an integral wedge section 30 for use with a wedge connector shell 32 for connecting the first connection section 22 with the first conductor. One example of a wedge connector shell is described in U.S. Pat. No. 5,507,671 which is hereby incorporated by reference in its entirety. However, in alternate embodiments, any suitable system for mechanically and electrically connecting the first conductor 12 to the first connection section 22 could be provided. For example, a non-wedge compression connection or a non-wedge mechanical connection could be used. The first connection section 12 comprises two leg sections 34 and a bottom platform section 36. The leg sections 34 are connected to the sections 28 of the electrical isolation section 26. The bottom platform section 36 extends between and beneath the two leg sections. However, in alternate embodiments, the first connection section 22 could comprise any suitable shape. The second connection section 24 is identical to the first connection section; just reversely orientated.

The electrical connection section 18 generally comprises a first end 38 movably connected to the first connection section 22 and an opposite second end 40 movably connected to the second connection section 24. In this embodiment the first end 38 is pivotably connected to the platform section 36 of the first connection section by a pivot connection 42. However, in alternate embodiments, any suitable type of movable connection could be provided. The pivot connection 42 electrically connects the first end 38 to the first connection section 22. The second end 40 is removably connected to the platform section of the second connection section by a latch assembly 44. The latch assembly 44 electrically connects the second end 40 to the second connection section 24. The latch assembly could comprise a primarily friction latch assembly, for example, and could comprise a detent system for preventing unintentional disconnection of the second end 40 from the latch assembly 44.

The electrical connection section 18 forms a movable arm connected between the first and second sections 22, 24. The arm comprises the first and second ends 38, 40 and a vacuum bottle section 46 between the two ends 38, 40. In an alternate embodiment, such as when the switch is not a vacuum recloser type of switch for example, the vacuum bottle section might not be provided. The vacuum bottle section comprises an outer housing 48 and at least two contacts 50, 52 located inside the housing 48. The first contact 50 is adapted to be moved into contact with and out of contact with the second contact 52. The housing 48 could comprise a window to allow a user to view the location of the contacts 50, 52 relative to each other, or the vacuum bottle section 46 could have any other suitable type of visual indicator to signal a user of the open or closed state of the contacts 50, 52. When the contacts 50, 52 are in an open state, the first and second connection sections are not electrically connected to each other. When the contacts 50, 52 are connected to each other in a closed state (with the electrical connection section 18 in the closed configuration shown in FIGS. 1 and 2; contacting the latch assembly 44), the first and second sections 22, 24 are electrically connected to each other.

The control 20 generally comprises three sections; an inductively coupled power supply section 54, a recloser electronic control section 56, and a capacitive discharge and solenoid actuation section 58. However, in an alternate embodiment, the control 20 might not be provided, such as when the switch is not a vacuum recloser type of switch for example. Alternatively, any suitable type of control could be provided. These three sections could be mounted on a single printed circuit board as separate modules for example. The inductively coupled power supply section 54 generally comprises a current transformer. Electricity can be inductively generated by the power supply section which is stored by the capacitors and powers the control section 56. The recloser electronic control section 56 generally comprises a voltage monitoring section. The control section 56 can continuously monitor the voltage from the current transformer and, thus, monitor the current being transmitted through the vacuum closer 10 between the two conductors 12, 14. A memory is provided on the printed circuit board which contains pre-installed action criteria. The recloser electronic control section 56 can use this pre-installed action criteria and sensed real time conditions to determine if the contacts 50, 52 of the vacuum bottle section 46 should be opened to stop transmission of current through the switch 10.

The capacitive discharge and solenoid actuation section 58 generally comprises capacitors and a solenoid 60. Electricity from the transformer can be stored in the capacitors for use in actuating the solenoid 60 when directed by the recloser electronic control section 56. The solenoid 60 is connected to the first contact 50 of the vacuum bottle section 46 by an armature mechanism 62. When the solenoid relay piston of the solenoid is moved outward, the armature mechanism 62 is adapted to move the first contact 50 out of contact with the second contact 52. Similarly, when the solenoid relay piston of the solenoid is moved inward, the armature mechanism 62 is adapted to move the first contact 50 into contact with the second contact 52. In one type of embodiment the solenoid is a bi-polar solenoid. However, any suitable solenoid could be used. Alternatively, any suitable type of armature drive system could be used.

Additionally, there will be a mechanical mechanism affixed to armature 60 that acts as a spring loaded trip mechanism where and when actuated by hand or hot stick 56 will trip (open) the contacts 50/52 of the vacuum bottle 18 to effectively disconnect electrical path 12 from 14. As a safety feature, there is preferably no provisions for mechanically reconnecting (closing electrical continuity) between 12 and 14 by a manual action of closing 50/52 on vacuum bottle 10.

After installation, when the line is energized, the power supply module takes power inductively from the energized circuit and allocates it to the recloser control module and the capacitive module section. The recloser electronic control supplies the intelligence to make open/close decisions. Signals from the current transformer and the voltage monitoring section of the power supply module are fed into the electronic control and are continuously monitored. Its decision to act is based on a comparison of what it is seeing (real-time) on the line with what is stored into its pre-installed memory as action criteria. If a line fault or disturbance occurs, it will be fed real-time to the closure control module. If the sensed real-time conditions meet the criteria required for an opened or closed action, it will instruct one or more of the power capacitors to discharge. The discharging capacitors have the required power to cause the solenoid to open or close causing the solenoid relay piston to move forward or backward. The piston is connected through a mechanism that is, in turn, connected to the vacuum bottle armature. The completed action results in the vacuum bottle contacts being opened or closed rapidly.

The system could also comprise a one-way or a two-way communication circuit 66 (see FIG. 1) to allow communication between multiple components in close proximity, or communication to and/or from a remote central monitoring station. Any suitable communication circuit could be provided, such as a wireless cellular, IR optical, FM wireless, satellite or any other commonly used SCADA (Supervisory Control And Data Acquisition) communications device for example. For example, if the communication circuit 66 allows communication with a remote central monitoring station, the communication circuit 66 could inform the monitoring station when the switch is automatically opened. Additionally, or alternatively, the communication circuit 66 could be used by the monitoring station to remotely trigger changing of the switch in the vacuum bottle section from an open state to a closed state. This might be particularly advantageous for reaching lines which otherwise would be accessed by helicopter. A stored energy circuit could be provided that utilizes Ferro resistant technology to store capacitive energy to power the vacuum bottle switching, the voltage/current sense and control circuit, and the communication circuitry. Alternatively, or additionally, other electrical or electronic devices could be provided, such as a tilt sensor which could sense if the conductors/switch fall down or a utility poll is knocked down, or a seismic sensor for example.

Figure 3:
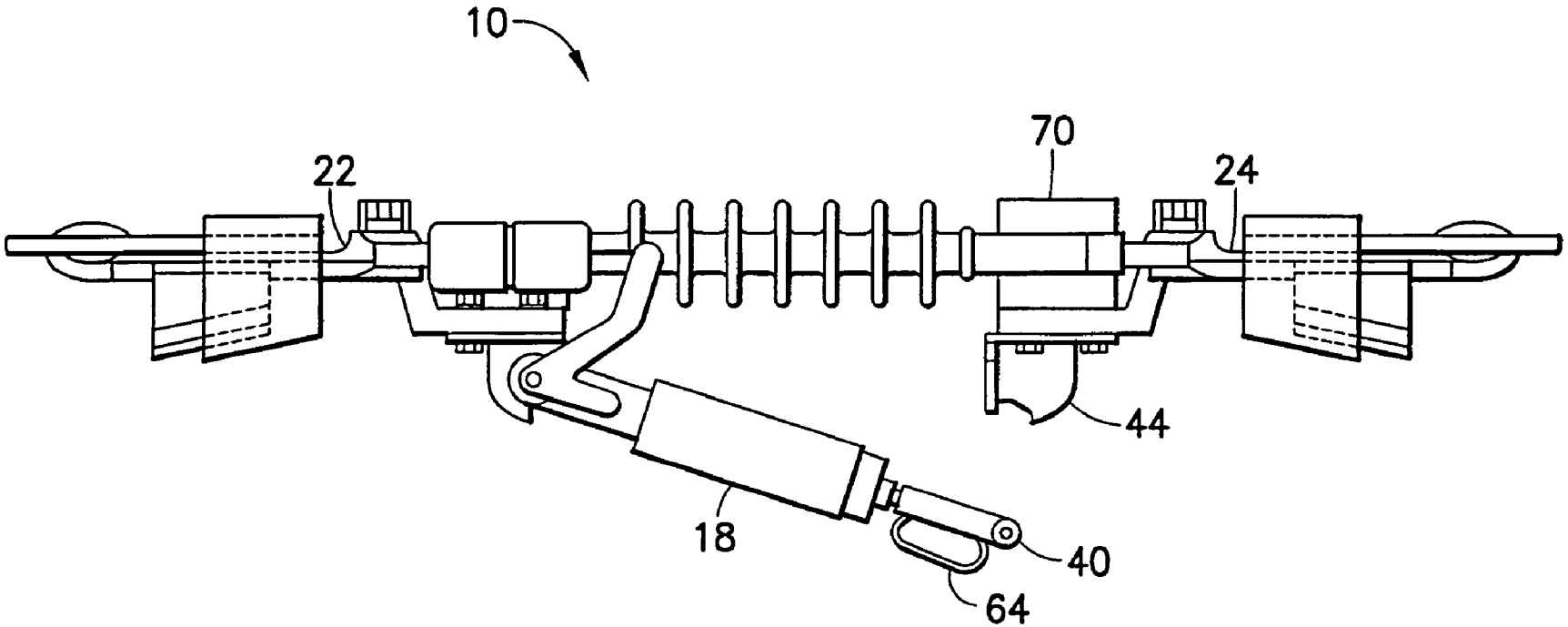
FIG. 3 is an elevational side view of the device shown in FIG. 1 with an arm of its electrical connection section moved to an open condition.

The set of contacts 50/52 can open and close to energize and de-energize the circuit while the switch remains in the visual representation shown in FIGS. 1 and 2. With a conventional switch, the contacts inside the vacuum bottle cannot be seen visually and there is way by which a person can visually verify a vacuum bottle open or closed contact state; except to trust an indicator mechanism on the solenoid armature mechanism that the contacts are open or closed. The invention, on the other hand as shown by FIG. 3, allows a user to physically disconnected the vacuum bottle from one of the high-voltage transmission lines. Historically, a user has always been very nervous about trusting his or her life to the little armature mechanisms that say the contacts (which are inside the little bottle and cannot seen) are open or closed.

The control 20, in combination with the armature mechanism 62 and the vacuum bottle section 46 form a first system for opening and closing a path between the first and second connection sections 22, 24. This first system can function automatically based upon real time conditions, such as opening the switch when a downstream fault or other system overload is occurring. In addition to this first system, the switch 10 comprises a second system for opening and closing the path between the first and second connection sections 22, 24. The second system allows a user to manually open and close the path by manually connecting and disconnecting the second end 40 of the vacuum bottle section with the second connection section 24. Referring also to FIG. 3, a further description will be provided.

FIG. 3 shows the switch 10 in a manually open state. FIGS. 1 and 2 shown the switch in a manually closed state. In the manually closed state, the contacts 50, 52 of the vacuum bottle section determine if the switch is opened or closed. In the manually open state, the switch is open regardless of the position of the contacts 50, 52 relative to each other. In the manually open state, the user has moved the second end 40 of the electrical connection section 18 away from connection with the latch assembly 44. This breaks the circuit path through the electrical connection section 18. The second end 40 has a handle 64 for the user to grasp or attach a hot stick to, in order to move the electrical connection section 18 to its open position. When the user is completed performing tasks downstream from the switch, the user can then merely return the electrical connection section 18 back to its closed position shown in FIGS. 1 and 2. Cycling of the electrical connection section 18 between its manually open and manually closed positions could also be used to reset the solenoid 60 and armature mechanism back to a home state.

The switch 10 includes a rotation stability device 70. As noted above, the switch 10 is mounted between two ends of the conductors 12, 14. Thus, the switch 10 is aligned along the axis 72 of the conductors 12, 14. This in-line arrangement makes the switch 10 prone to rotation about the axis 72. As noted above, there is a common problem that a service crew experiences when opening and predominately when closing a switch latch by hot stick. The entire device tends to rotate on the conductors during the attempt. Unless the service crew stops the rotation (spin), then positions his/herself directly under the device, lining up the switch handle so that the upward pushing force being applied is parallel with the conductor, the switch may have difficultly closing or not close all the way. This can obviously create a safety issue.

The rotation stability device 70 is a device adapted to prevent, or at least reduce, rotation of the switch 10 about the axis 72. This stabilizes the switch 10 to allow the electrical connection section 18 to be more easily manually closed and opened by a user, such as when using a hot stick for example. In a preferred embodiment, the rotation stability device 70 comprises a gyroscope. Having a gyroscope allows the electrical connection section 18 to be moved from its open position shown in FIG. 3 to its closed position shown in FIGS. 1-2 with minimal rotational movement of the device 10 about the axis 72.

Figure 4:
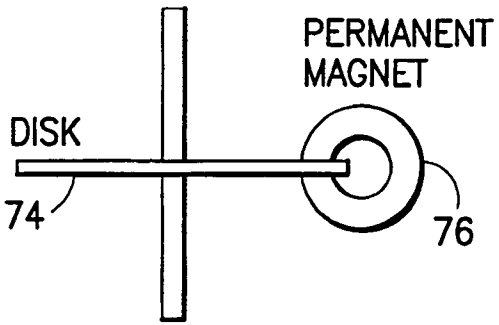
FIG. 4 is a view showing one example of components of a gyroscope which could be used with the invention.

The gyroscope 70 would ideally be centered and mounted along the axis on the device so that the rotational spin prevents rotation of the device mounted on the conductors 12, 14, but attachment to any portion of the switch will minimize rotation so long the rotational portion of the gyroscope is on the same plane (parallel) as the conductor. However, optimum benefit is achieved when positioned on the conductor axis. A magnetically suspended, zero friction aluminum rotor disk and shaft assembly of sufficient mass relative to the switch 10 intended to be stabilized can be used. The gyroscope could be designed around the same principles used to inductively drive the aluminum disk in KWH meters. The design could have a minimal retarding magnet so as to maintain constant high rotational speed (RPMs) on the disk. Once rotating, it would provide a gyroscopically stable platform. An example of the drive is shown in FIG. 4.

The aluminum disk 74 is acted upon by three coils; the voltage coil creates magnetic flux that is proportional to the applied voltage. The current coil produces a magnetic flux that is proportional to the current. As the disk moves through the magnetic field of the first coil the flux through the disk changes, causing an emf around paths through the disk. This occurs due to Faraday's law, which shows that the change in flux over time equals the electric field in a conductor. Since the disk is conducting, this emf will cause current to flow due to Ohm's law. This current will be directly proportional to the emf and indirectly proportional to the resistance of the aluminum disk. The current will circulate in a direction to produce a magnetic field opposite to the uniform field. This direction is determined by Lenz's law where "The direction of any magnetic induction effect is such as to oppose the cause of the effect. It is helpful to use the right-hand rule for a closed loop to determine the direction of the current flow to produce this opposing field. The circulating current then interacts with the B-field of the two coils that induce fluxes that are proportional to the current. These two coils are usually located under the aluminum disk 74 while the voltage coil is usually located on top of the aluminum disk 74.

The circulating current that interacts with the B-field from the lower coils produces a force that creates a counter-clockwise torque on the aluminum disk. At first inspection you would suspect that the aluminum disk would constantly accelerate. This is not true. The torque is opposed by a force that is created by a "C" shaped permanent magnet 76. This permanent magnet is oriented with the aluminum disk 74 as shown in FIG. 4. This permanent magnet 76 interacts with eddy currents that are produced by the change of flux. This change of flux is created because the magnet is moving in relation to the aluminum disk. The same affect is created when you drop a bar magnet down a copper tube. A force opposes gravity that slows down the magnet. The force is proportional to the speed. In alternate embodiments, any suitable type of anti-rotation or rotation stability device could be provided.

By developing a device to prevent rotational movement, closing of the switch becomes very simple and would mean many users, who up to now would not consider these types of devices due to this problem, might now consider using this type of in-line switch.

One purpose could be to provide rotational stability and/or an artificial center of gravity for a switch or device that must be operated (such as opened/closed) by a "hot stick" from a bucket truck or from the ground by service personnel. Another purpose could be to provide stability for an electronic device used to record measurements that require a stable reference point, such as wind speed, rotational shift, galloping or conductor vibration.

Figure 5:
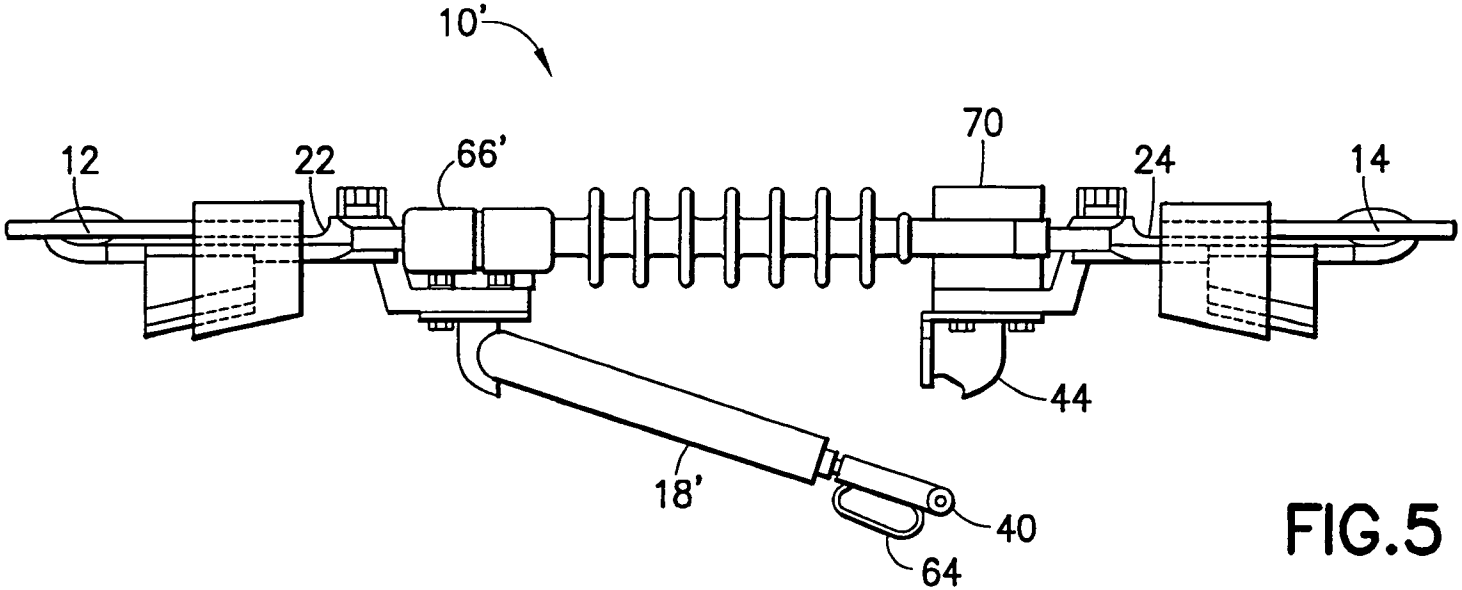
FIG. 5 is a side view of an alternate embodiment of the invention shown in FIG. 1-4.

As noted above, the invention can be used in a device which is not a vacuum recloser type of switch. An example of this is shown in FIG. 5. The device 10' shown in FIG. 5 is an in-line switch similar to that shown in FIG. 1, but has an electrical connection section 18' which does not comprise a vacuum recloser bottle section. In addition, an electronic device 66' is provided instead of the control 20. This switch 10' is intended for only manual opening and closing, but includes the rotational stability device 70 to help prevent rotation of the device 10' about the axis of the conductors 12, 14.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An in-line electrical conductor switch comprising:

a frame comprising first and second connection sections insulated from each other by an electrical isolation section, wherein the first and second connection sections are configured to connect to respective ends of first and second electrical conductors, wherein the switch is entirely supported by the first and second electrical conductors;

an electrical connection section movably connected to the frame between a first connected position which electrically connects the first and second connection sections to each other, and a second disconnected position which does not electrically connect the first and second connection sections to each other; and a rotational stability device connected to the frame and adapted to reduce or prevent rotation of the frame about an axis through the ends of the electrical conductors during movement of the electrical connection section to the second disconnected position.

2. An in-line electrical conductor switch as in claim 1 wherein the electrical isolation section comprises two parallel sections connecting the first and second connection sections to each other with an open area therebetween.

3. An in-line electrical conductor switch as in claim 1 wherein the first and second connection sections each comprise a conductor receiving channel for receiving the first and second electrical conductors, respectively.

4. An in-line electrical conductor switch as in claim 1 wherein the electrical connection section comprises a first end pivotably connected to the first connection section and an opposite second end removably connected to the second connection section.

5. An in-line electrical conductor switch as in claim 1 wherein the electrical connection section comprises a vacuum recloser.

6. An in-line electrical conductor switch as in claim 1 wherein the rotation stability device comprises a gyroscope.

7. An in-line electrical conductor switch as in claim 1 further comprising an electronic device mounted on the frame.

8. An in-line electrical conductor switch as in claim 7 wherein the rotation stability device comprises a gyroscope.

9. An in-line electrical conductor switch as in claim 8 wherein the gyroscope comprises an inductively driven gyroscope.

10. An in-line electrical conductor switch as in claim 9 wherein the electrical connection section comprises a vacuum recloser.

11. An in-line electrical conductor switch as in claim 10 wherein the electrical connection section comprises a first end pivotably connected to the first connection section and an opposite second end removably connected to the second connection section.

12. An in-line electrical conductor switch as in claim 11 wherein the first and second connection sections each comprise a conductor receiving channel for receiving the first and second electrical conductors, respectively.

13. An in-line electrical conductor switch as in claim 12 wherein the electrical isolation section comprises two parallel sections connecting the first and second connection sections to each other with an open area therebetween.

14. A device comprising:

a frame comprising first and second connection sections insulated from each other by an electrical isolation section, wherein the first and second connection sections are configured to connect to respective ends of first and second electrical conductors, wherein the device is entirely supported by the first and second electrical conductors;

an electronic device mounted to the frame; and a rotational stabilizer connected to the frame and adapted to reduce or prevent rotation of the frame about an axis through the ends of the electrical conductors, wherein the rotational stabilizer stabilizes the frame to thereby stabilize the electronic device and reduce rotational motion of the electronic device about the axis.

15. A device as in claim 14 wherein the electrical isolation section comprises two parallel sections connecting the first and second connection sections to each other with an open area therebetween.

16. An in-line electrical conductor switch as in claim 14 wherein the first and second connection sections each comprise a conductor receiving channel for receiving the first and second electrical conductors, respectively.

17. An in-line electrical conductor switch as in claim 14 further comprising an electrical connection section comprises a first end pivotably connected to the first connection section and an opposite second end movably connected to the second connection section.

18. An in-line electrical conductor switch as in claim 17 wherein the electrical connection section comprises a vacuum recloser.

19. An in-line electrical conductor switch as in claim 18 wherein the rotation stability device comprises a gyroscope.

20. An in-line electrical conductor switch as in claim 14 wherein the rotation stability device comprises an inductively powered gyroscope.

21. A method of manufacturing a device comprising:

providing a frame comprising first and second connection sections insulated from each other by an electrical isolation section, wherein the first and second connection sections are configured to connect to respective ends of first and second electrical conductors, and wherein the device is entirely supported by the first and second electrical conductors;

connecting an electrical connection section to the frame, wherein the electrical connection section is movably connected to the frame between a first connected position which electrically connects the first and second connection sections to each other, and a second disconnected position which does not electrically connect the first and second connection sections to each other; and connecting a rotational stabilizer to the frame, wherein the rotational stabilizer is adapted to reduce or prevent rotation of the frame about an axis through the ends of the electrical conductors during movement of the electrical connection section to the second disconnected position.

22. A method of closing an electrical switch comprising:

providing the electrical switch with a frame comprising first and second connection sections insulated from each other by an electrical isolation section, wherein the first and second connection sections are configured to connect to respective ends of first and second electrical conductors, wherein the switch is entirely supported by the first and second electrical conductors;

moving an electrical connection section on the frame from a disconnected position to a connected position, wherein in the disconnected position the electrical connection section does not electrically connect the first and second connection sections to each other, and wherein in the connected position the electrical connection section electrically connects the first and second connection sections to each other; and preventing the frame from significantly rotating about an axis through the ends of the first and second electrical conductors while the electrical connection section is moved to the connection position comprising a gyroscope on the frame creating an artificial center of gravity.

* * * * *